US005207518A

United States Patent [19]

Hayashi

[11] Patent Number: 5,207,518

[45] Date of Patent: May 4, 1993

[54] PIEZOELECTRIC PRINTER

[75] Inventor: Mikio Hayashi, Tokyo, Japan

[73] Assignee: Seikosha Co., Ltd., Tokyo, Japan

[21] Appl. No.: 678,565

[22] Filed: Mar. 28, 1991

[30] Foreign Application Priority Data

Mar. 30, 1990 [JP] Japan ..... 2-86871
Mar. 30, 1990 [JP] Japan ..... 2-86872

[51] Int. Cl.[5] ..... B41J 2/30
[52] U.S. Cl. ..... 400/124; 101/93.05
[58] Field of Search ..... 400/124, 124 PZ; 101/93.05

[56] References Cited

FOREIGN PATENT DOCUMENTS 0202864 11/1984 Japan ..... 400/124
0227653 10/1987 Japan ..... 400/124
0248657 10/1987 Japan ..... 400/124
0109662 5/1989 Japan ..... 400/124
2198604 6/1988 United Kingdom ..... 400/124

*Primary Examiner*—Edgar S. Burr
*Assistant Examiner*—John S. Hilten
*Attorney, Agent, or Firm*—Jordan and Hamburg

[57] ABSTRACT

A piezoelectric printer including a piezoelectric actuator having piezoelectric elements for driving printing elements. A drive voltage applied to the piezoelectric elements for printing operations fluctuates with a predetermined period and amplitude. The drive voltage applied to the piezoelectric elements can fluctuate with a period or amplitude related to a gradation signal for effecting printing gradation.

16 Claims, 5 Drawing Sheets

PIEZOELECTRIC PRINTER

FIELD OF THE INVENTION

This invention relates to a piezoelectric printer for printing operations using a piezoelectric actuator to drive printing elements by the movement of piezoelectric elements.

BACKGROUND OF THE INVENTION

One known piezoelectric printer prints one dot by an impact established by applying a printing pulse voltage to a piezoelectric element fixed to a lever spring. The pulse drives the spring to thereby move a printing wire attached to the lever spring. Thus, such a piezoelectric printer can be more compact than the printer of electromagnetic drive type.

Since the printing energy has to be generated by the single action of the piezoelectric element, this element has to be enlarged or driven with a high voltage. Thus, the problem arises that the heat structure is complicated and that the electric power requirements are increased.

Moreover, gradation of the printing is effected by a netting method and is accompanied by the problem that a complicated driver is required. If 16 gradations are required, for example, one dot is imagined to be composed of 4×4 pixels so that a gradation of multiple stages for the printing density may be achieved by printing all the 16 pixels for a deep black but none of the pure white, and by printing a proper number of pixels for a half tone. In order to effect gradation in this netting method, it is necessary to provide a complicated driver for controlling which pixel is to be printed according to the stage of half tone.

SUMMARY OF THE INVENTION

It is, therefore, an object of the present invention to provide a piezoelectric printer which can use small piezoelectric elements, can achieve a high printing force with a low voltage and can effect gradation with a simple driver.

In order to achieve the above object, according to the present invention, a piezoelectric printer is provided which comprises a piezoelectric actuator including piezoelectric elements for driving printing elements and in which a drive voltage to be applied to the piezoelectric element for printing operations is controlled to fluctuate at a predetermined period and amplitude.

Since the drive voltage to be applied to the piezoelectric elements fluctuates at a predetermined period and amplitude, the piezoelectric elements are vibrated not only by the printing pulse voltage at the time of printing but also by minute vibrations according to the aforementioned period and amplitude, so that vibrations of the two types are both transmitted to the printing elements to establish a high printing force.

If the drive voltage applied to the piezoelectric elements is fluctuated according to a period or amplitude related to a gradation signal for effecting printing gradation, the piezoelectric elements and accordingly the printing elements are minutely vibrated by the gradation signal according to that period or amplitude so that the printing energies for the individual dots are changed at the printing time to establish a gradation of multiple stages for the printing density.

BRIEF DESCRIPTION OF THE DRAWINGS

In order that the invention may be more clearly understood, it will now be disclosed in greater detail with reference to the accompanying drawing, wherein:

FIGS. 2(*a*)–2(*c*) illustrate various waveforms using fixed oscillations, wherein:

FIG. 2(*a*) shows the waveform of the oscillating pulses;

FIG. 2(*b*) shows the waveform of the printing pluses; and

FIG. 2(*c*) shows the waveform of the drive voltage to be applied to the piezoelectric element;

FIGS. 3(*a*)–3(*d*) illustrate various waveforms, in a first example of oscillation control, wherein:

FIG. 3(*a*) illustrates the oscillatory pulses;

FIG. 3(*b*) illustrates the oscillation control signal;

FIG. 3(*c*) illustrates the printing pulse; and

FIG. 3(*d*) illustrates the drive voltage to be applied to the piezoelectric element;

FIGS. 4(*a*)–4(*d*) illustrate various waveforms, in a second example of oscillation control, wherein:

FIG. 4(*a*) illustrates the oscillatory pulses;

FIG. 4(*b*) illustrates the oscillation control signal;

FIG. 4(*c*) illustrates the printing pulse; and

FIG. 4(*d*) illustrates the drive voltage to be applied to the piezoelectric element;

FIG. 5(*b*) is a cross-sectional view taken along line A—A of FIG. 5(*a*);

FIGS. 7(*a*)–7(*c*) illustrate waveforms of the system of FIG. 6, wherein:

FIG. 7(*a*) illustrates the elementary output;

FIG. 7(*b*) illustrates the printing pulse signal;

FIG. 7(*c*) illustrates the drive voltage to be applied to the piezoelectric element; and FIG. 7(*d*) illustrates the displacement of the leading end portion of the printing wires.

DESCRIPTION OF THE PREFERRED EMBODIMENT

Figure 1:
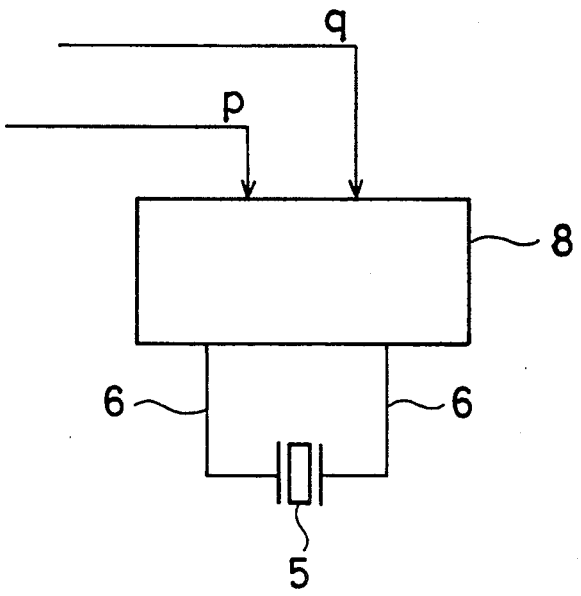
FIG. 1 is a block diagram showing a driver according to one embodiment of the invention.
Figure 5A:
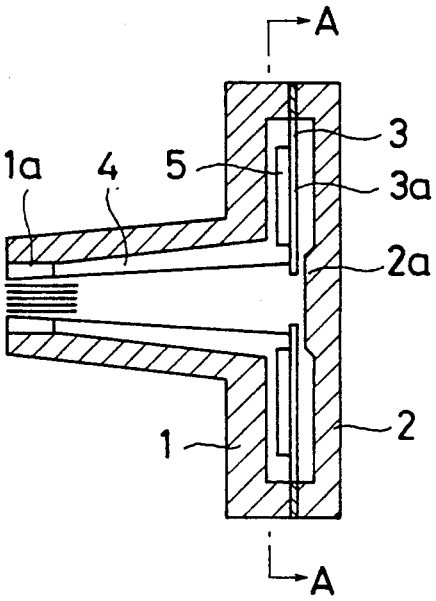
FIG. 5(*a*) is a cross-sectional view of a printing head.
Figure 5B:
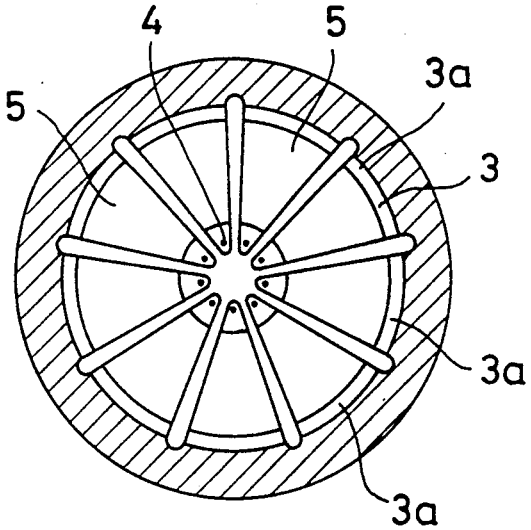

The printing head illustrated in FIGS. 5(*a*) and 5(*b*) is comprised of a leaf spring 3 fixedly held between a front casing 1 and a rear casing 2. The leaf spring 3 is prepared by dividing the inner portion of a circular elastic plate into nine sectors 3*a*. Printing wires 4 are affixed to the inner end portions of these sectors 3*a*, to function as the printing elements. These printing wires 4 have leading end portions supported to slide back and forth (i.e., to the right and left, as seen in FIG. 5(*a*)) by a guide la disposed in the front casing 1. Piezoelectric elements 5 are affixed to the fronts of the individual sectors 3*a* of the leaf spring 3. These piezoelectric elements 5 and the individual sectors 3*a* of the leaf spring 3 constitute a piezoelectric actuator. As shown in FIG. 1, the two faces of the piezoelectric elements 5 are connected to an oscillatory driver 8 via signal lines 6 of a cable (not shown) so that they may generate a predetermined electric field. The central portion of the rear casing 2 has a land 2*a* which acts as a stopper when the leaf spring 3 retracts. The stopper 2*a* is spaced a small distance from the natural position of the leaf spring 3 so that it does not obstruct small high-frequency vibrations of the leaf spring 3.

As shown in FIG. 1, a driver is comprised of an oscillatory driver 8 including an oscillator for generating a high frequency pulse voltage. The pulse voltage to be output from the oscillator has its frequency and amplitude set to have a predetermined period and amplitude with respect to the minute vibrations of the printing wire 4. The oscillatory vibrator 8 is controlled by a printing pulse signal p and an oscillation control signal q. Specifically, the oscillation control signal q controls the oscillation timing of the high-frequency voltage, and the printing pulse signal p is superposed on the drive voltage for printing operations.

Several different drive voltages that may be selectively output from the oscillatory driver 8 will now be described with reference to FIGS. 2(*a*) to 2(*c*).

Figure 2:
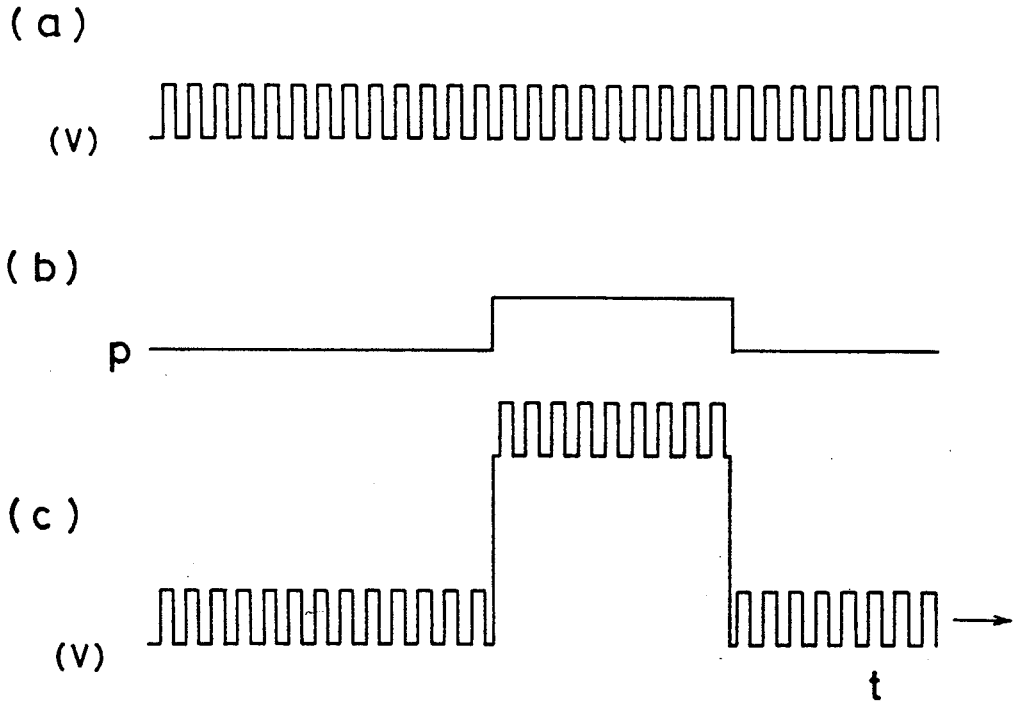

If the oscillations are fixed, the oscillator output, as shown in FIG. 2(*a*), is output from the oscillatory driver 8 at all times. When the printing pulse signal p is input, as shown in FIG. 2(*b*), the oscillatory driver 8 controls the oscillator output so that the potential of the oscillator output is raised for that period and changed into an oscillatory driver output, as shown in FIG. 2(*c*).

Figure 3:
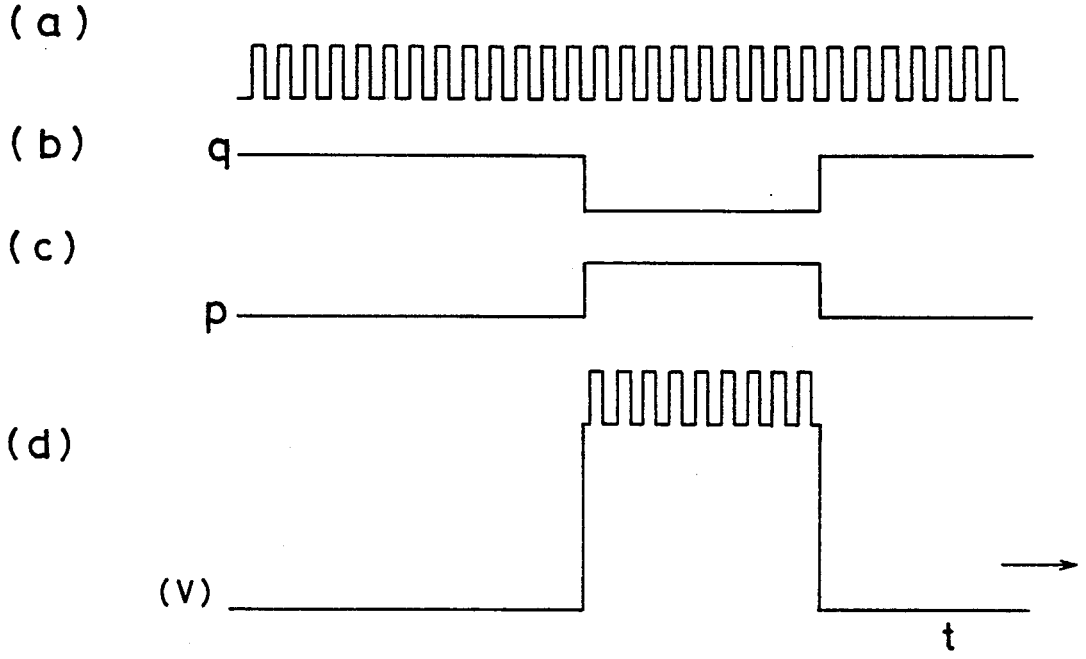

In a first example of controlled oscillations, the oscillator output of FIG. 3(*a*) is output from the oscillatory driver 8 only when the driver receives the oscillation control signal q, as shown in FIG. 3(*b*). When the printing pulse signal p is input, as shown in FIG. 3(*c*), the oscillatory driver 8 controls the oscillator output so that the potential of the oscillator output is raised for that period and changed into an oscillatory driver output, as shown in FIG. 3(*d*). The oscillation control signal q and the printing pulse signal p are synchronously input with an equal duration. As a result, the high-frequency pulse voltage is applied only for the time period during which the printing pulse voltage is being applied.

Figure 4:
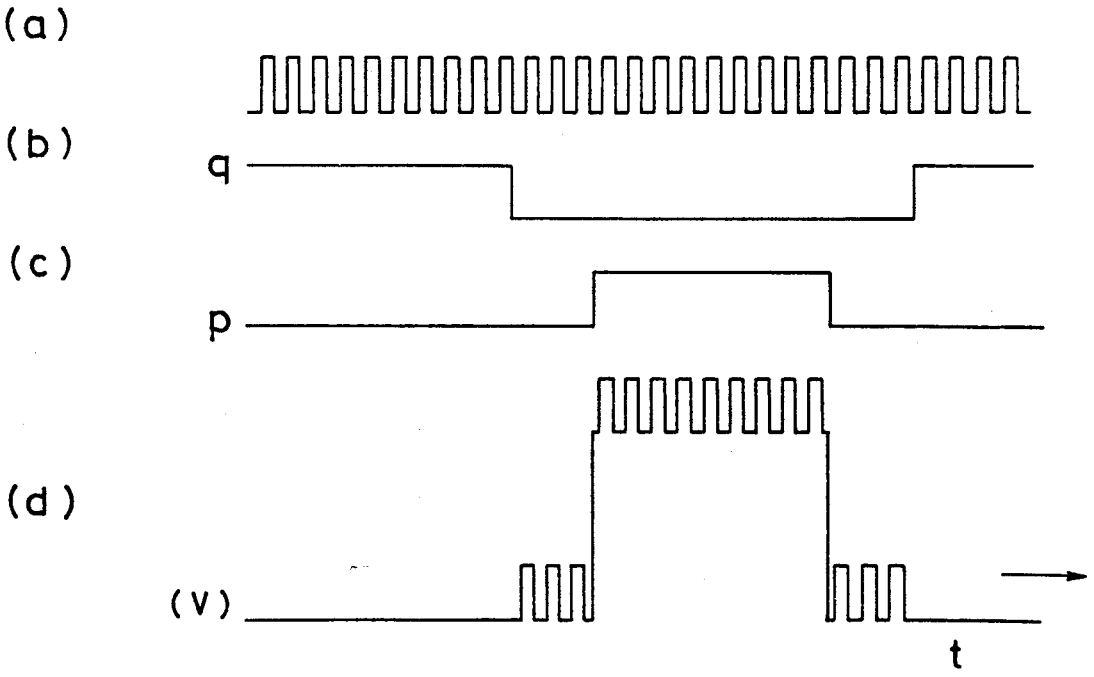

In a second example of controlled oscillation, the oscillator output of FIG. 4(*a*) is output from the oscillatory driver 8 only when the oscillation control signal q is input, as shown in FIG. 4(*b*) is input. If the printing pulse signal p is input, as shown in FIG. 4(*c*), the oscillatory driver 8 controls the oscillator output so that the potential of the oscillator output is raised for that period and changed into an oscillatory driver output, as shown in FIG. 4(*d*). In this embodiment, the changing position of the oscillation control signal q is intrinsically synchronized and adjusted to the rising position of the printing pulse, and the duration of the oscillation control signal q is longer by a predetermined time duration than that of the printing pulse signal p. Moreover, the printing pulse signal transmitter (not shown) detects the change in the oscillation control signal q and inputs the printing pulse signal p for a slightly later time period. As a result, the high-frequency pulse voltage is applied for a constant time period encompassing the time period during which the printing pulse voltage is applied.

In the embodiment of the invention depicted with reference to FIG. 2(*a*) to 2(*c*), the piezoelectric element is continuously fed the high-frequency pulse voltage, when fixed frequency oscillations are provided, so that it is minutely vibrated at a high frequency.. As a result, the printing wires 4 are minutely vibrated at all times with a high frequency via the leaf spring 3. At the printing time, moreover, the printing pulse voltage is output and applied to the piezoelectric element 5 in response to the printing pulse signal p so that the piezoelectric element 5 contracts to warp the leaf spring 3 significantly in the forward direction. As a result, the printing wires 4 are controlled to protrude forward, while being minutely vibrated, so that they impinge upon the recording paper held on the platen through the ribbon, to accomplish printing operations. When the printing pulse signal p disappears, the printing wires 4 and the leaf spring 3 retract to abut against the stopper 2*a* until they are restored to their initial positions. The printing energy for applying the ink of the ribbon to the recording paper is derived from the sum of the kinetic energy of the minute high-frequency vibrations and the kinetic energy of the large warping displacement so that a strong printing force can be obtained to print the dots clearly. Since, moreover, the printing wires 4 are minutely vibrating at a high frequency at all times, the time for establishing the minute vibrations need not be taken into consideration, to exhibit an excellent effect even in high-speed printing operations.

In the embodiments of the invention depicted in FIGS. 3(*a*) to 3(*d*) and 4(*a*) to 4(*d*), the minute high-frequency vibrations of the leaf spring 3 and the printing wires 4 are generated either only while the printing pulse voltage is applied or only for a constant time period encompassing the former time. As a result, the printing energy can be high as in the case of the fixed oscillations, and the energy for establishing the minute high-frequency vibrations can be smaller than when fixed oscillations are generated.

Figure 6:
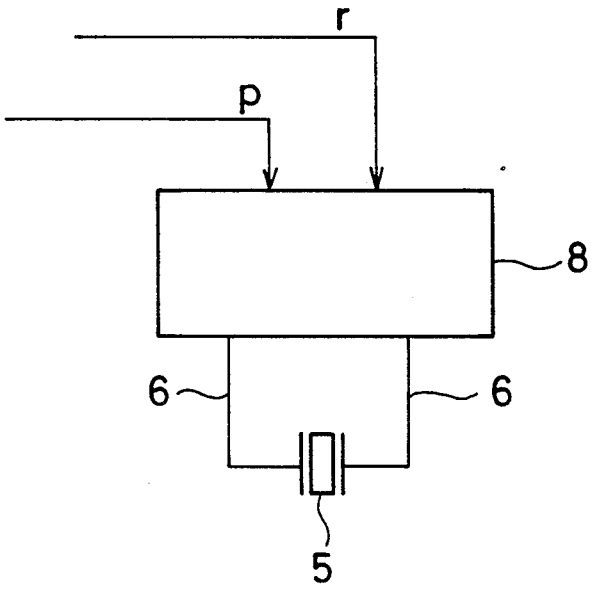
FIG. 6 is a block diagram showing a modification of the driver.
Figure 7:
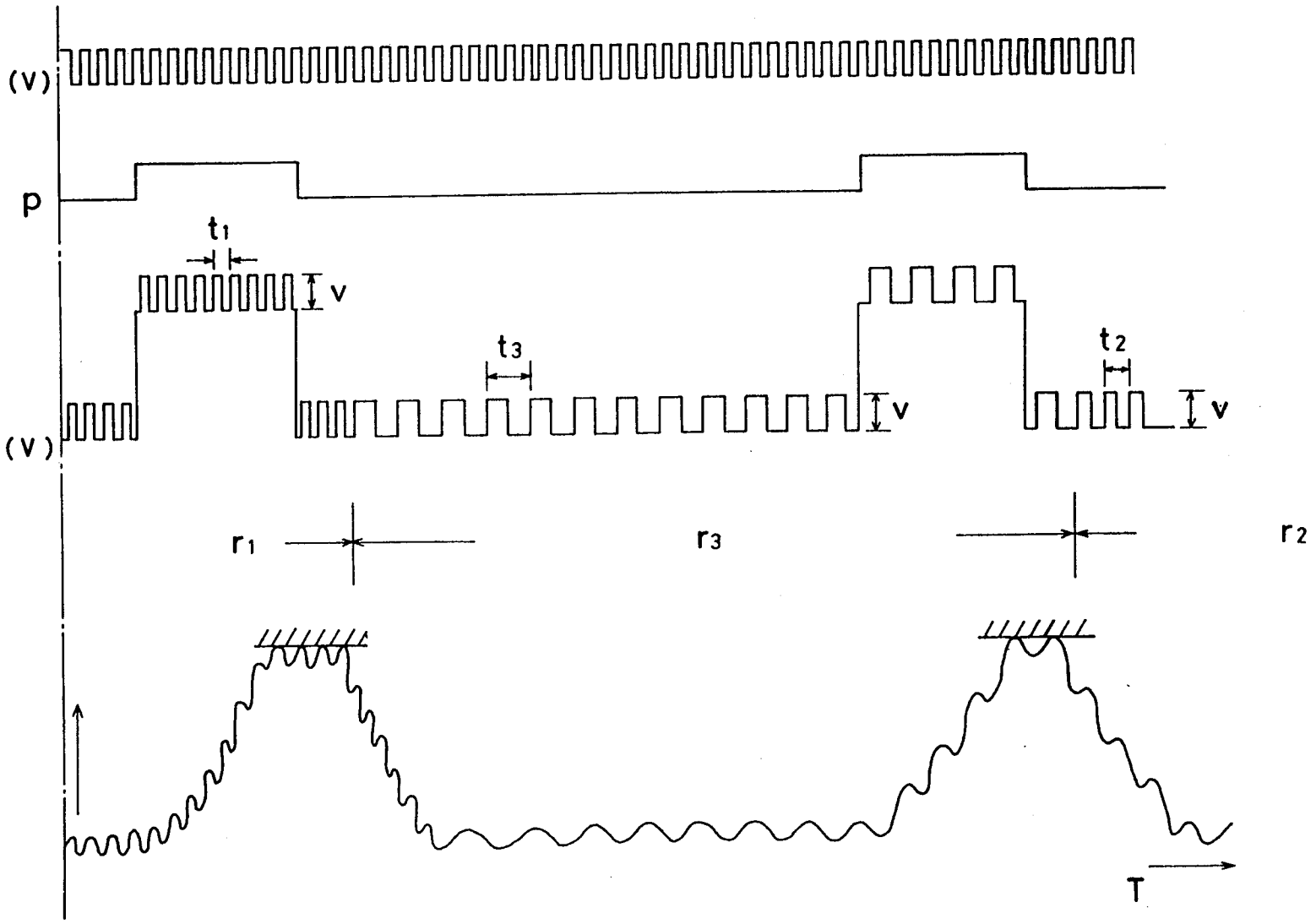

In the modification of the invention illustrated in FIG. 6, the oscillatory driver 8 includes an oscillator for oscillating a high-frequency pulse voltage so that a high-frequency pulse voltage, as exemplified in FIG. 7(*a*), is output from the oscillatory driver 8. The oscillator is selectively fed a plurality of gradation signals r ($r_1$ to $r_n$) for effecting a printing gradation so that the frequency or amplitude of the high-frequency pulse voltage can be changed. The oscillatory driver 8 is also fed the printing pulse signal p so that a driving voltage for the printing operations is superposed on the oscillator output.

If the gradation signal $r_2$ is fed to the oscillator at the printing time, for example for high-density prints, the high-frequency pulse voltage to be output from the oscillator is controlled to have a period $t_2$ in response to that gradation signal $r_2$. If the printing pulse signal p is then input, as shown in FIG. 7(*b*), the oscillatory driver 8 controls the oscillator output so that the potential of the oscillator output is raised for this time period and changed into the oscillatory driver output, as indicated for the range of the gradation signal $r_2$ of FIG. 7(*c*). When a gradation signal $r_3$ is then fed at a printing time for low-density prints, the period of the high-pulse voltage output from the oscillator is changed to $t_3$ in response to that gradation signal $r_3$. If the printing pulse signal p is input, as described above, the oscillatory driver output is changed into the output indicated for the range of the gradation signal $r_3$ of FIG. 7(*c*). For the printing time for intermediate-density prints, the gradation signal $r_2$ is fed to change the period to $t_2$ so that the oscillatory driver output is changed into the oscillatory driver output, as indicated by the range of the gradation signal $r_2$ of FIG. 7(*c*).

According to the present embodiment, a high-frequency pulse voltage of a predetermined period responding to the gradation signal 4 is applied to the piezoelectric element 5. As a result, the piezoelectric element 5 is minutely vibrated at the high frequency to vibrate the printing wires 4 minutely at the high frequency via the leaf spring 3. At the printing time, moreover, the printing pulse voltage is output and applied to the piezoelectric element 5 in response to the printing pulse signal p so that the piezoelectric element 5 contacts to warp the leaf spring 3 substantially in the forward direction. As a result, the printing wires 4 protrude forward while being minutely vibrated for a predetermined period, so that they abut the recording paper held on the platen, through the ribbon, to effect printing operations. When the printing pulse signal p disappears, the printing wires and the leaf spring 3 retract to abut the stopper 2*a* and to be restored to their initial positions. The printing energy for applying the ink of the ribbon to the recording paper is derived from the sum of the kinetic energy of the minute high-frequency vibrations and the kinetic energy of the large warping displacement.

Since the drive voltage is changed as a function of the gradation signal r, as has been described hereinbefore, the period of the minute vibrations of the printing wire is also changed for each printing dot in response to the gradation signal r. Specifically, for a printing dot responsive to the gradation signal $r_2$, the period, i.e., intensity of the minute vibrations for the printing wires 4 to transmit the recording paper is increased, as shown at the left-hand side of FIG. 7(*d*), so that highly dense prints can be achieved. For a printing dot responsive to the gradation signal $r_3$, the density of the prints is low, as shown at the intermediate portion of FIG. 7(*d*). For a printing dot corresponding to the gradation signal $r_2$, the density of the prints is intermediate. Thus, the density of the ink of the ribbon to be applied to the recording paper is changed by selecting the gradation signal r so that a gradation of multiple stages for the printing density can be achieved.

The period of the high-frequency minute vibrations of the printing wires 4 is changed in the aforementioned embodiment. The printing gradation may be alternatively attained by changing the amplitude v of the high-frequency pulse voltage in response to the gradation signal r, to control the printing gradation.

The high-frequency pulse voltage may be applied only while the printing pulse voltage is being applied, or for a constant period including the period of the pulse voltage. Thus, the energy consumption can be reduced.

In the above discussed embodiments, the voltage applied to the piezoelectric element 5 to vibrate the printing wires 4 minutely at a high frequency is indicated to be a high-frequency pulse voltage, but it may alternatively be exemplified by a voltage having a high-frequency sinusoidal waveform.

The structure of the invention thus far described, can establish a strong printing force with a small piezoelectric element and with reduced power consumption. Moreover, the inertia of the spring can be small to establish a high-speed response.

If, on the other hand, the drive voltage applied to the piezoelectric element fluctuates with a period or amplitude related to the gradation signal, for controlling printing gradation, the gradation of the printing density can be achieved using a simple driver, and the printing energy can be changed to effect gradation in stable operations. If a netting method is used in combination with the method of the invention, a very fine gradation can be obtained merely by adding a simple driver.

If, moreover, the high-frequency oscillations are within an ultrasonic region, striking noise at the time of printing can be reduced to provide a low-noise piezoelectric printer.

What I claim is:

1. In a piezoelectric printer having a piezoelectric actuator including a plurality of piezoelectric elements for driving printing elements and a source of pulses for controlling said piezoelectric elements to drive said printing elements during printing operations, the improvement comprising a source of gradation signals and drive means including a source of high frequency oscillations of predetermined frequency and amplitude, said drive means being responsive to said control pulses for outputting drive pules with said high frequency oscillations superimposed thereon for application to said piezoelectric elements, whereby said piezoelectric elements vibrate during said printing operations, said high frequency oscillations superimposed on said drive pulses having amplitudes substantially smaller than said drive pulses, said drive means comprising means responsive to said gradation signals for varying the frequency of said high frequency oscillations.

2. The piezoelectric printer of claim 1 wherein said drive means comprises means for continuously applying said high frequency oscillations to said piezoelectric elements both during and in an absence of said drive pulses.

3. The piezoelectric printer of claim 1, wherein said drive means comprises means for applying said high frequency oscillations to said piezoelectric elements only during said drive pulses.

4. The piezoelectric printer of claim 1, wherein said drive means comprises means for applying said high frequency oscillations to said piezoelectric elements only in a pulsatory period of greater duration than said drive pulses, said drive pulses occurring during the time of occurrence of said oscillations.

5. The piezoelectric printer of claim 1, wherein said source of oscillations comprises a source of oscillations of constant frequency and amplitude.

6. In a piezoelectric printer having a piezoelectric actuator including a plurality of piezoelectric elements for driving printing elements and a source of pulses for controlling said piezoelectric elements to drive said printing elements during printing operations, the improvement comprising a source of gradation signals and drive means including a source of high frequency oscillations of predetermined frequency and amplitude, said drive means being responsive to said control pulses for outputting drive pules with said high frequency oscillations superimposed thereon for application to said piezoelectric elements, whereby said piezoelectric elements vibrate during said printing operations, said high frequency oscillations superimposed on said drive pulses having amplitudes substantially smaller than said drive pulses, said drive means comprising means responsive to said gradation signals for varying the frequency of said high frequency oscillations.

7. The piezoelectric printer of claim 6 wherein said drive means comprises means for continuously applying said high frequency oscillations to said piezoelectric elements both during and in an absence of said drive pulses.

8. The piezoelectric printer of claim 6, wherein said drive means comprises means for applying said high frequency oscillations to said piezoelectric elements only during said drive pulses.

9. The piezoelectric printer of claim 6, wherein said drive means comprises means for applying said high frequency oscillations to said piezoelectric elements only in pulsatory period of greater duration than said drive pulses, said drive pulses occurring during the time of occurrence of said oscillations.

10. The piezoelectric printer of claim 6, wherein said source of oscillations comprises a source of oscillations of constant frequency and amplitude.

11. The method for driving printing elements of a piezoelectric printer wherein said printing elements are connected to be driven by piezoelectric elements, including applying drive pulses to said piezoelectric elements during printing operations, wherein the improvement comprises generating high frequency oscillations of predetermined frequency and amplitude, superimposing said high frequency oscillations on said drive pulses whereby said printing elements vibrate during said printing operations, providing gradation signals, and varying the frequency of said oscillations in response to said gradation signals.

12. The method of claim 11 further comprising applying said high frequency oscillations to said piezoelectric elements also in the event of an absence of said drive pulses.

13. The method of claim 12 wherein said step of applying said high frequency oscillations to said piezoelectric elements comprises applying said oscillations to said piezoelectric elements during pulses of longer duration than said drive pulses, said drive pulses occurring during the time of occurrence of said oscillations.

14. The method for driving printing elements of a piezoelectric printer wherein said printing elements are connected to be driven by piezoelectric elements, including applying drive pulses to said piezoelectric elements during printing operations, wherein the improvement comprises generating high frequency oscillations of predetermined frequency and amplitude, and superimposing said high frequency oscillations on said drive pulses whereby said printing elements vibrate during said printing operations, providing gradation signals, and varying the amplitude of said oscillations in response to said gradation signals.

15. The method of claim 14 further comprising applying said high frequency oscillations to said piezoelectric elements also in the event of an absence of said drive pulses.

16. The method of claim 15 wherein said step of applying said high frequency oscillations to said piezoelectric elements comprises applying said oscillations to said piezoelectric elements during pulses of longer duration than said drive pulses, said drive pulses occurring during the time of occurrence of said oscillations.

* * * * *